US005989086A

United States Patent [19]

Danchik

[11] Patent Number: 5,989,086

[45] Date of Patent: Nov. 23, 1999

[54] OUTBOARD MOTOR FLUSHING DEVICE

[76] Inventor: Aaron E. Danchik, 15245 La Maida St. Unit #304, Sherman Oaks, Calif. 91403

[21] Appl. No.: 09/179,378

[22] Filed: Oct. 26, 1998

[51] Int. Cl.[6] ..... B63H 21/10

[52] U.S. Cl. ..... 440/88; 440/113

[58] Field of Search ..... 440/88, 89, 113, 440/900

[56] References Cited

U.S. PATENT DOCUMENTS

| | | | |
|---|---|---|---|
| 5,350,329 | 9/1994 | Haman | 440/88 |
| 5,634,833 | 6/1997 | Watanabe | 440/88 |
| 5,823,836 | 10/1998 | Anderson | 440/88 |
| 5,830,023 | 11/1998 | Brogdon | 440/88 |

*Primary Examiner*—Stephen Avila

[57] ABSTRACT

The present invention is a new and improved outboard motor flushing device system for simplifying the cleaning of small horsepower motors. The system includes a horizontally oriented support plate for an outboard motor. A backing plate with long horizontal upper and lower edges and short vertical front and rear edges is positioned adjacent to the support plate with a space therebetween. The backing plate has clamps adjacent to the front edge and the rear edge with coupling bolts and wing nuts. The backing plate also has a water port therethrough with a pair of spaced apertures on opposite sides of the port. A pad is positioned between the support plate and the backing plate with an enlarged opening overlying the hole. A water channel has a bore with a sideways facing input end and an output end overlying the water port with threaded apertures on opposite sides of the water port with two screws passing through the vertically spaced apertures and engageable in the threaded apertures for the selective positioning of the housing with respect to the backing plate. Lastly provided is a horn. The horn has a threaded coupler at its inboard end secured with respect to the backing plate, and an intermediate portion extending through the pad. An enlarged outboard end is provided for directing a flow of water over the input end of the motor.

4 Claims, 3 Drawing Sheets

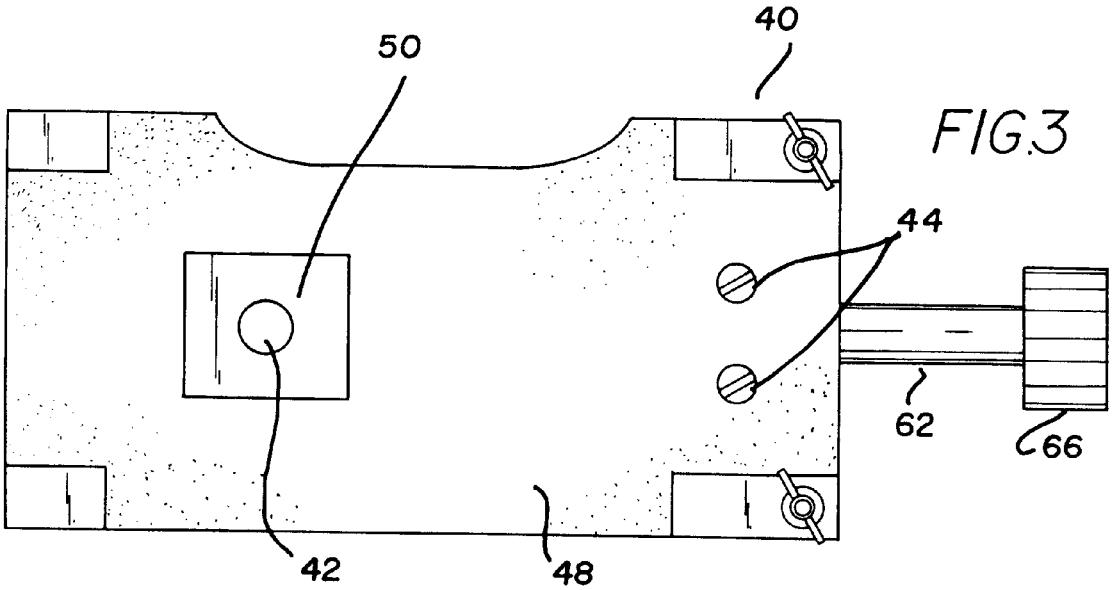
FIG.3
FIG.4
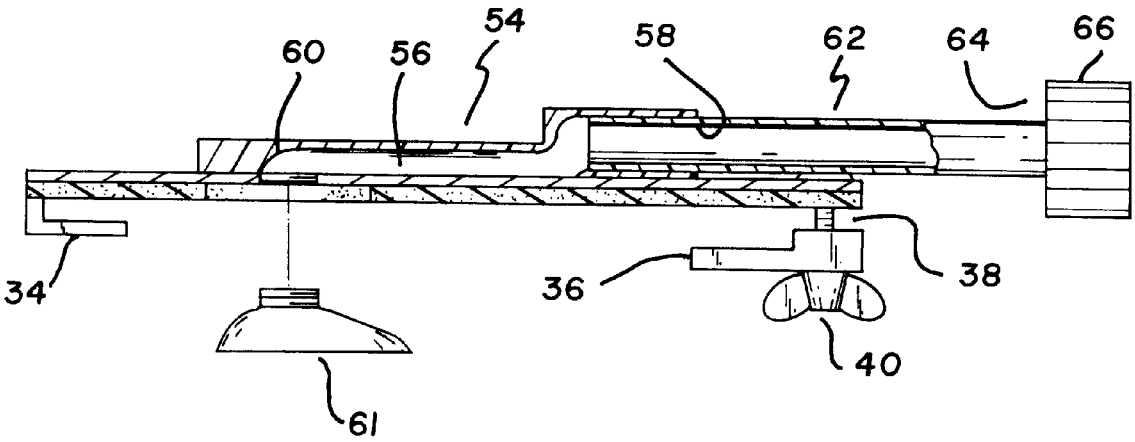

OUTBOARD MOTOR FLUSHING DEVICE

BACKGROUND OF THE INVENTION

1. Field of the Invention

The present invention relates to a new and improved outboard motor flushing device and, more particularly, pertains to simplifying the cleaning of small horsepower motors.

2. Description of the Prior Art

The use of outboard motors and maintenance features of known designs and configurations is known in the prior art. More specifically, outboard motors and maintenance features of known designs and configurations heretofore devised and utilized for the purpose of simplifying the maintenance of motors or other aquatic equipment through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of outboard motors and maintenance features of known designs and configurations. By way of example, U.S. Pat. No. 5,350,329 to Haman, issued Sep. 27, 1994 discloses a flushing system for outboard motor.

U.S. Pat. No. 5,634,833 to Watanabe, issued Jun. 3, 1997 discloses a flushing system for outboard motor.

U.S. Pat. No. 4,540,009 to Karls, issued Sep. 10, 1985 discloses a flushing device for outboard motors.

U.S. Pat. No. 3,134,388 to Peloso, issued May 26, 1964 discloses a marine engine flushing.

U.S. Pat. No. 2,644,474 to Houchin, issued Jul. 7, 1953 discloses a means for flushing outboard motors.

Lastly, International Patent Number WO 95/18291 to Waelput, et al., issued Jul. 6 1995 discloses adapters for flushing an internal combustion engine.

In this respect, the outboard motor flushing device according to the present invention substantially departs from the conventional concepts and designs of the prior art, and in doing so provides an apparatus primarily developed for the purpose of simplifying the cleaning of small horsepower motors.

Therefore, it can be appreciated that there exists a continuing need for a new and improved outboard motor flushing device which can be used for simplifying the cleaning of small horsepower motors. In this regard, the present invention substantially fulfills this need.

SUMMARY OF THE INVENTION

In view of the foregoing disadvantages inherent in the known types of outboard motors and maintenance features of known designs and configurations now present in the prior art, the present invention provides a new and improved outboard motor flushing device. As such, the general purpose of the present invention, which will be described subsequently in greater detail, is to provide a new and improved outboard motor flushing device and methods which have all the advantages of the prior art and none of the disadvantages.

To attain this, the present invention essentially comprises a new and improved outboard motor flushing device system comprising, in combination, a motor with a propeller and a water intake and with a horizontal support plate thereabove;

a rectangular backing plate fabricated of aluminum with long horizontal upper and lower edges and short vertical front and rear edges positionable adjacent to the support plate with a space therebetween, the backing plate having fixed clamps adjacent to the front edge and adjustable clamps adjacent to the rear edge with coupling bolts and wing nuts, the backing plate also having a circular water port therethrough with a pair of vertically spaced apertures on opposite sides of the port; a porous foam pad, preferably neoprene, positioned between the support plate and the backing plate with an enlarged rectangular opening overlying the circular hole; a water channel having a central bore with a sideways facing input end and an output end overlying the water port with two rows of threaded apertures on opposite sides of the water port with two screws passing through the vertically spaced apertures and selectively engageable in the threaded apertures for the selective positioning of the housing with respect to the backing plate; a rigid horn-shaped adapter having a threaded coupler at its inboard end secured with respect to the backing plate, and an intermediate portion extending through the foam pad, and an enlarged outboard end for directing a flow of water over the input end of the motor; a tubular coupler having an output end located within the input end of the housing and an input end with a female hose fitting whereby when a hose is coupled to the fitting it will force pressurized water through the housing, backing plate and the horn to clean the motor; and a support plate adapted to support a motor with a propeller and a water intake.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved outboard motor flushing device which has all the advantages of the prior art outboard motors and maintenance features of known designs and configurations and none of the disadvantages.

It is another object of the present invention to provide a new and improved outboard motor flushing device which may be easily and efficiently manufactured and marketed.

It is a further object of the present invention to provide a new and improved outboard motor flushing device which is of a durable and reliable construction.

An even further object of the present invention is to provide a new and improved outboard motor flushing device which is susceptible of a low cost of manufacture with regard to both materials and labor, and which accordingly is then susceptible of low prices of sale to the consuming public, thereby making such a outboard motor flushing device economically available to the buying public.

Even still another object of the present invention is to simplify the cleaning of small horsepower motors.

Lastly, it is an object of the present invention to provide an outboard motor flushing device. The device includes a horizontally oriented support plate for an outboard motor. A backing plate with long horizontal upper and lower edges and short vertical front and rear edges is positionable adjacent to the support plate with a space therebetween. The backing plate has clamps adjacent to the front edge and the rear edge with coupling bolts and wing nuts. The backing plate also has a water port therethrough with a pair of spaced apertures on opposite sides of the port. A pad is positioned between the support plate and the backing plate with an enlarged opening overlying the hole. A water channel has a bore with a sideways facing input end and an output end overlying the water port with threaded apertures on opposite sides of the water port with two screws passing through the vertically spaced apertures and engageable in the threaded apertures for the selective positioning of the housing with respect to the backing plate. Lastly, a horn is provided as part of the system. The horn has a threaded coupler at its inboard end secured with respect to the backing plate, and an intermediate portion extending through the pad. An enlarged outboard end is provided for directing a flow of water over the input end of the motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear elevational view of the system shown in FIG. 2.

FIG. 4 is a cross-sectional view taken essentially through the system of FIGS. 2 and 3.

The same reference numerals refer to the same parts throughout the various Figures.

DESCRIPTION OF THE PREFERRED EMBODIMENT

Figure 1:
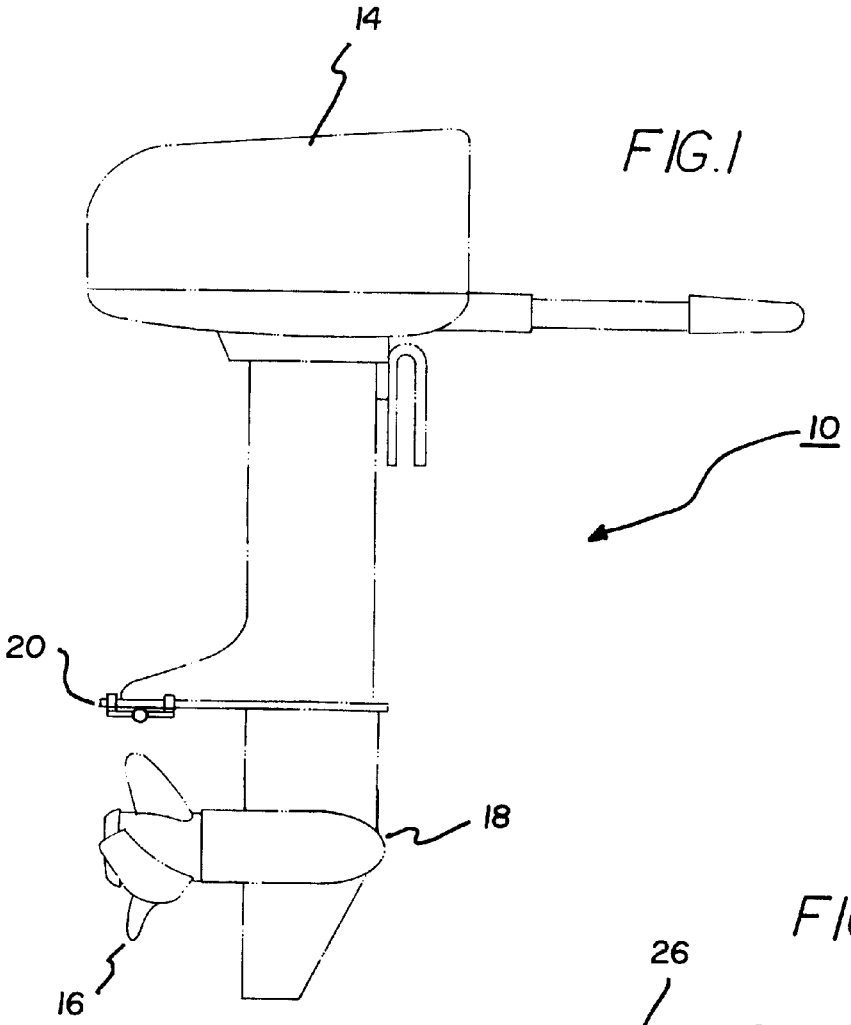
FIG. 1 is a side elevational view of the new and improved outboard motor flushing device constructed in accordance with the principles of the present invention.
Figure 2:
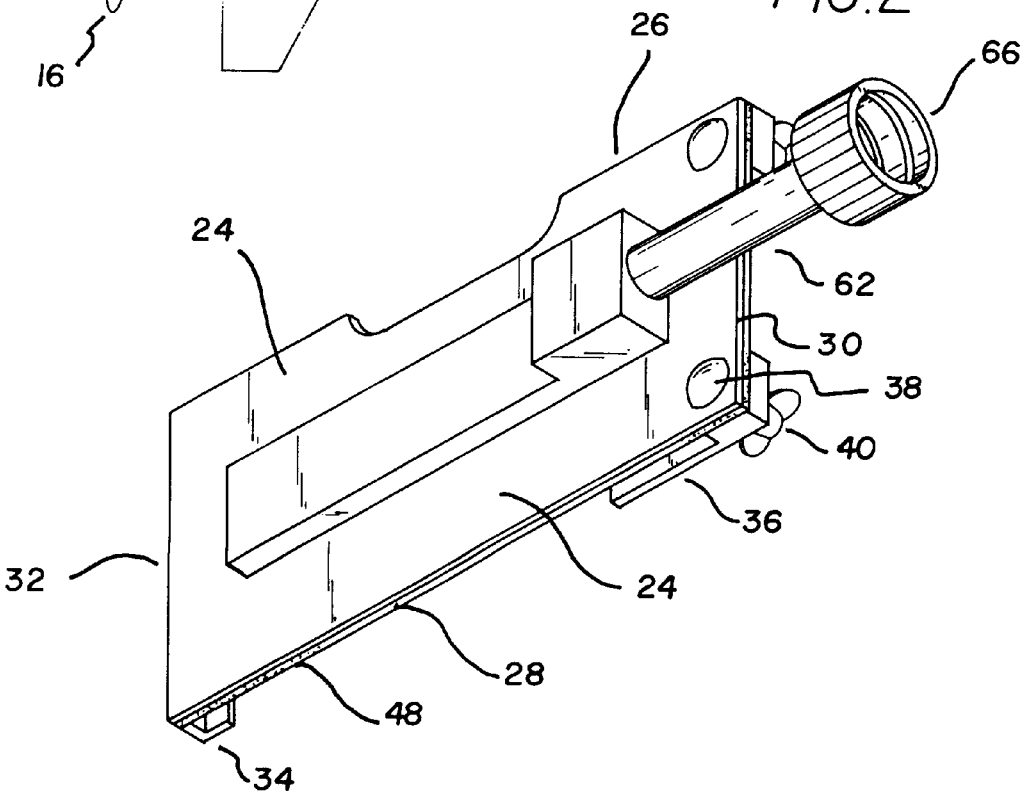
FIG. 2 is a perspective view of the flushing system shown in FIG. 1.
Figure 5:
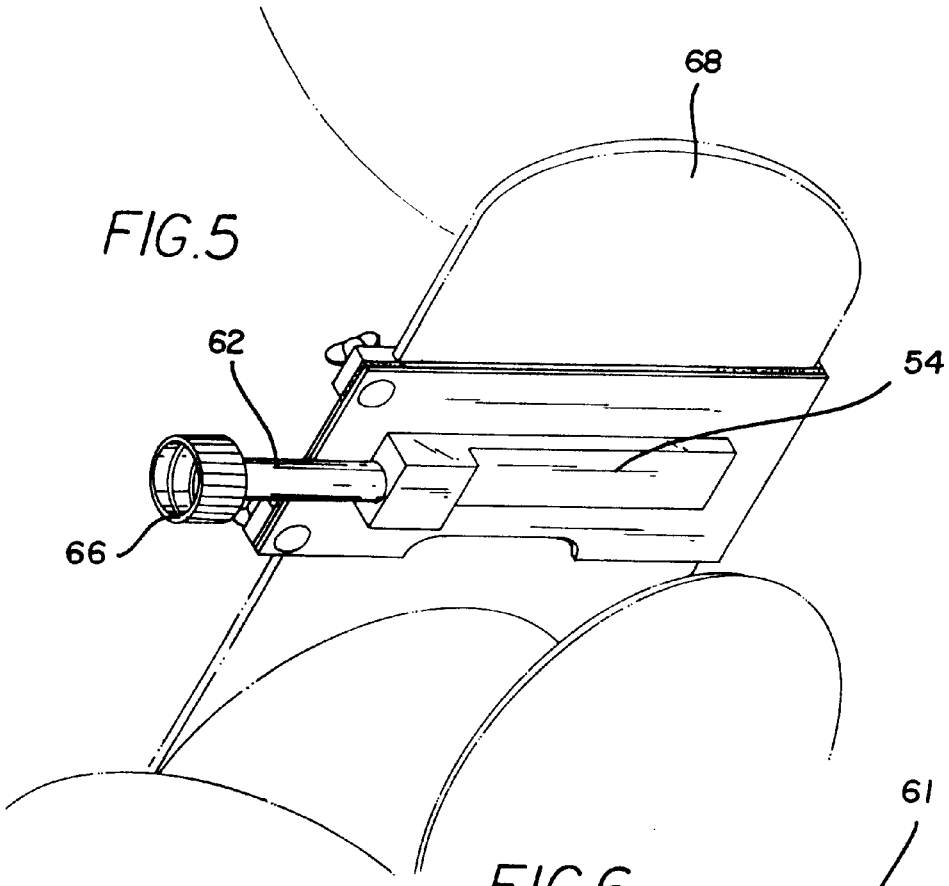
FIG. 5 is a perspective illustration of the flushing system similar to FIG. 2 but taken from a different angle.
Figure 6:
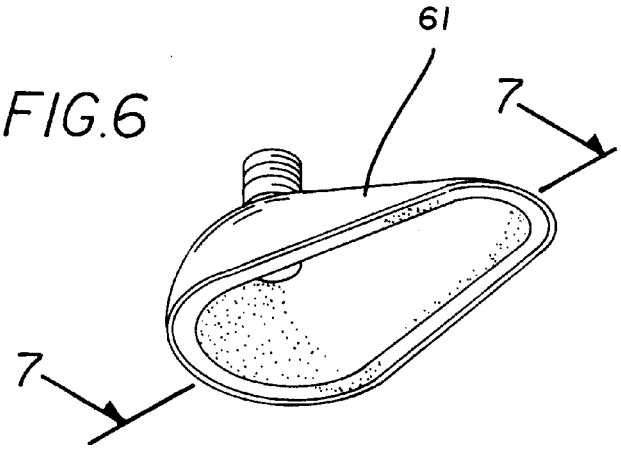
FIG. 6 is a perspective illustration of the rigid horn-shaped adapter shown in FIG. 4.
Figure 7:
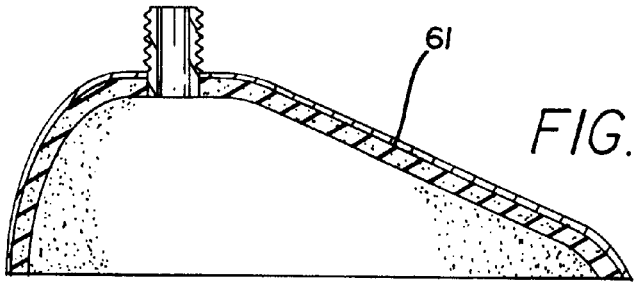
FIG. 7 is a cross-sectional view taken along line 7—7 of FIG. 6.

With reference now to the drawings, and in particular to FIGS. 1 through 4 thereof, the new and improved outboard motor flushing device embodying the principles and concepts of the present invention and generally designated by the reference numeral 10 will be described.

The present invention, the new and improved outboard motor flushing device, is a system 10 comprised of a plurality of components. Such components, in their broadest context, include a motor, a rectangular backing plate, a foam pad, a water channel, a horn-shaped adapter, a coupler and a support plate. Each of the individual components is specifically configured and correlated one with respect to the other so as to attain the desired objectives.

The present invention is a new and improved outboard motor flushing device system 10 for simplifying the cleaning of small horsepower motors. The system is provided with a motor 14 with a propeller 16 and a water intake 18. A horizontal support plate 20 is located thereabove. The system also includes a rectangular backing plate 24. The backing plate is fabricated of aluminum. The backing plate has long horizontal upper and lower edges 26,28. The backing plate also has short vertical front and rear edges 30, 32 positionable adjacent to the support plate with a space therebetween. Fixed clamps 34 are located adjacent to the front edge of the backing plate. Adjustable clamps 36 are located adjacent to the rear edge. The backing plate also has coupling bolts 38 and wing nuts 40. Further included as part of the backing plate is a circular water port 42 therethrough with a pair of vertically spaced apertures 44 on opposite sides of the port.

The next major component of the system is a porous foam pad 48, preferably neoprene. The pad is positioned between the support plate and the backing plate with an enlarged rectangular opening 50 overlying the circular hole.

A water channel 54 is next provided. The water channel has a central bore 56 with a sideways facing input end 58 and an output end 60 overlying the water port. Two rows of threaded apertures are positioned on opposite sides of the water port. Two screws pass through the vertically spaced apertures and selectively engage in the threaded apertures for the selective positioning of the housing with respect to the backing plate.

Additionally provided is a rigid horn-shaped adapter 61. The adapter has a threaded coupler at its inboard end secured with respect to the backing plate. An intermediate portion extends through the foam pad. An enlarged outboard end directs a flow of water over the input end of the motor.

Also provided is a tubular coupler 62 having an output end located within the input end of the housing. The tubular coupler also has an input end 64 with a female hose fitting 66. When a hose is coupled to the fitting it will force pressurized water through the housing, backing plate and the horn-shaped adapter to clean the motor.

Lastly provided is a support plate 68 adapted to support a motor with a propeller and water intake.

The present invention is a tool designed to simplify the cleaning of smaller horsepower outboard motors. It enables a user to flush out the motor without disassembling it. It eliminates the need to keep a 30 to 50 gallon tank to secure the motor to for starting and flushing. The present invention fits between the engine's water intake and propeller. Maintenance is performed more quickly. The present invention provides an advantage for boat owners or boat renter operations in that it aids in performance of regular maintenance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved outboard motor flushing device system comprising, in combination:

a motor with a propeller and a water intake and with a horizontal support plate thereabove;

a rectangular backing plate fabricated of aluminum with long horizontal upper and lower edges and short vertical front and rear edges positionable adjacent to the support plate with a space therebetween, the backing plate having fixed clamps adjacent to the front edge and adjustable clamps adjacent to the rear edge with coupling bolts and wing nuts, the backing plate also having a circular water port therethrough with a pair of vertically spaced apertures on opposite sides of the port;

a porous foam pad, preferably neoprene, positioned between the support plate and the backing plate with an enlarged rectangular opening overlying the circular hole;

a water channel having a central bore with a sideways facing input end and an output end overlying the water port with two rows of threaded apertures on opposite sides of the water port with two screws passing through the vertically spaced apertures and selectively engageable in the threaded apertures for the selective positioning of the housing with respect to the backing plate;

a rigid horn-shaped adapter having a threaded coupler at its inboard end secured with respect to the backing plate, and an intermediate portion extending through the foam pad, and an enlarged outboard end for directing a flow of water over the input end of the motor;

a tubular coupler having an output end located within the input end of the housing and an input end with a female hose fitting whereby when a hose is coupled to the fitting it will force pressurized water through the housing, backing plate and the horn to clean the motor; and a support plate adapted to support a motor with a propeller and a water intake.

2. An outboard motor flushing device system comprising:

a horizontally oriented support plate for an outboard motor;

a backing plate with long upper and lower edges and short front and rear edges positionable adjacent to the support plate with a space therebetween, the backing plate having clamps adjacent to the front edge and adjacent to the rear edge with coupling bolts and wing nuts, the backing plate also having a water port therethrough with a pair of spaced apertures on opposite sides of the port;

a pad positioned between the support plate and the backing plate with an enlarged opening overlying the hole;

a water channel having a bore with a sideways facing input end and an output end overlying the water port with threaded apertures on opposite sides of the water port with screws passing through the spaced apertures and engageable in the threaded apertures for the selective positioning of the housing with respect to the backing plate; and a horn having a threaded coupler at its inboard end secured with respect to the backing plate, and an intermediate portion extending through the foam pad, and an enlarged outboard end for directing a flow of water over the input end of the motor.

3. The system as set forth in claim 2 and further including:

a tubular coupler having an output end located within the input end of the housing and an input end with a female hose fitting whereby when a hose is coupled to the fitting it will force pressurized water through the housing, backing plate and the horn to clean the motor.

4. The system as set forth in claim 2 and further including:

a support plate adapted to support a motor with a propeller and a water intake.

* * * * *